US009640049B2

(12) United States Patent
Na

(10) Patent No.: US 9,640,049 B2
(45) Date of Patent: May 2, 2017

(54) SECURITY DEVICE FOR INTRUSION DETECTION

(71) Applicant: AMBUS CO., LTD., Yongin-si, Gyeonggi-do (KR)

(72) Inventor: Kee-Woon Na, Yongin-si (KR)

(73) Assignee: AMBUS CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 14/760,631

(22) PCT Filed: Jan. 2, 2014

(86) PCT No.: PCT/KR2014/000003

§ 371 (c)(1),
(2) Date: Jul. 13, 2015

(87) PCT Pub. No.: WO2014/112734

PCT Pub. Date: Jul. 24, 2014

(65) Prior Publication Data

US 2015/0356839 A1 Dec. 10, 2015

(30) Foreign Application Priority Data

Jan. 16, 2013 (KR) ..... 10-2013-0004937

(51) Int. Cl.
*G08B 13/00* (2006.01)
*G08B 13/02* (2006.01)
*G08B 13/08* (2006.01)

(52) U.S. Cl.
CPC ..... *G08B 13/02* (2013.01); *G08B 13/08* (2013.01)

(58) Field of Classification Search
CPC ..... G08B 13/02
USPC .... 340/541, 545.1, 546, 545.5, 545.8, 545.2
See application file for complete search history.

(56) References Cited

U.S. PATENT DOCUMENTS 4,293,778 A * 10/1981 Williams ..... G08B 13/126 307/147
4,814,750 A * 3/1989 Abramson ..... G08B 13/126 340/550
4,839,632 A * 6/1989 Zahn, Jr. ..... G08B 13/126 200/61.81

(Continued)

FOREIGN PATENT DOCUMENTS

KR 1020100052238 A 5/2010
KR 2020100008669 U 9/2010

(Continued)

OTHER PUBLICATIONS

International Search Report for PCT/KR2014/00003 dated Feb. 19, 2014.

*Primary Examiner* — Brent Swarthout
(74) *Attorney, Agent, or Firm* — Hauptman Ham, LLP

(57) ABSTRACT

The present invention relates to a security device for detecting an intrusion including at least one sensor frame including a sensor, a first connection frame for connecting a signal sensed from the sensor frame, and a signal processing frame for detecting an intrusion from the sensed signal received from the first connection frame or the sensor frame, wherein the at least one sensor frame is detachably connected to the security device. Accordingly, the security device can be easily installed, use a variety of sensors, and be changed in size.

15 Claims, 9 Drawing Sheets

(56) References Cited

U.S. PATENT DOCUMENTS

| | | | | |
|---|---|---|---|---|
| 4,999,608 | A * | 3/1991 | Galomb | G08B 13/126 340/547 |
| 5,594,418 | A * | 1/1997 | Martin | G08B 13/126 200/61.93 |
| 2008/0100465 | A1 * | 5/2008 | Montague | E06B 7/32 340/652 |

FOREIGN PATENT DOCUMENTS

| | | | |
|---|---|---|---|
| KR | 101054862 | B1 | 8/2011 |
| KR | 101220812 | B1 | 1/2013 |

* cited by examiner

SECURITY DEVICE FOR INTRUSION DETECTION

TECHNICAL FIELD

The present invention relates to a security device for intrusion detection, and more particularly, to a security device for intrusion detection which can be easily installed in a target object on an intrusion route, have sensors installed therein, and be changed in size.

BACKGROUND ART

There are generally known security devices for business or commercial buildings in order to protect property in the business or commercial buildings and prevent an intrusion into the buildings. Further, there exist service providers which install and manage the security devices.

Examples of sensors used in the security devices for the business buildings include magnetic sensors, passive-infrared sensors, and infrared sensors. In general, the sensors of this type are properly operated in the business buildings without any problems.

Namely, since no one is inside the business buildings after work or during the holidays, the security devices have only to detect intruders by means of the sensors. Furthermore, the business buildings are usually maintained under constant conditions. Specifically, since users in the business buildings usually close all of doors and windows when leaving the buildings or after work and the security devices are operated while no one is inside the buildings, the security devices are usually operated under steady conditions in the business buildings and thus can easily detect intruders.

However, the security devices of this type may not be suitable for household use when they are installed in residences, such as apartments or detached houses.

First of all, since such a household residence may not be maintained under constant conditions, it may be hard to detect intruders. Specifically, since residents are likely to be always present in the household residence, move at the inside of the household residence at any time during the day or night, and keep windows open particularly in the summer season, it is complicated to determine under what conditions an intrusion occurs, and thus it is hard to determine whether or not an intrusion occurs.

In addition, the household residence is not easy to install security devices or security equipment including the security devices. Specifically, tenants may not be allowed to install the security devices in their residence. Besides, although the tenants or other residents (e.g., residence owners) are allowed to install the security devices in their residence, the installation of security devices may cause a change in structure of the residence space, which needs to be performed by installation professionals or incurs huge installation costs.

In view of the above, a new security device for intrusion detection is needed which can easily detect intrusions even in an environment where it is not easy to detect the intrusions and can be easily installed with reduced costs.

DISCLOSURE

Technical Problems

In order to solve the above-mentioned problems, the present invention provides a security device for intrusion detection which can be easily installed in business or residential buildings with reduced installation costs.

Furthermore, the present invention provides a security device for intrusion detection which can be adapted to a variety of intrusion detection conditions to easily detect intrusions.

In addition, the present invention provides a security device for intrusion detection which can be applied to a variety of buildings or a variety of installation environments in the buildings by extending or reducing the size of the security device.

These technical problems are for illustrative purposes only and not for purposes of limiting the same. Other technical problems will become apparent to those skilled in the art from the following detailed description which discloses exemplary embodiments of the invention.

Technical Solutions

In one general aspect, there is provided a security device for detecting an intrusion, including: at least one sensor frame including a sensor; a first connection frame for connecting a signal sensed from the sensor frame; and a signal processing frame for detecting an intrusion from the sensed signal received from the first connection frame or the sensor frame, wherein the at least one sensor frame is detachably connected to the security device.

In another general aspect, there is provided a security device for detecting an intrusion, including: a first sensor which is installed to face outside to detect approaching a target object; and a second sensor which detects motion of the security device, wherein the security device is formed to be hung on the target object or a support member of the target object.

Advantageous Effects

According to an embodiment of the present invention, the security device for intrusion detection can be easily installed in business or residential buildings with reduced installation costs.

Furthermore, the security device for intrusion detection can be adapted to a variety of intrusion detection conditions to easily detect intrusions.

In addition, the security device for intrusion detection can be applied to a variety of buildings or a variety of installation environments in the buildings by extending or reducing the size of the security device.

These advantageous effects are for illustrative purposes only and not for purposes of limiting the same. Other advantageous effects will become apparent to those skilled in the art from the following detailed description which discloses exemplary embodiments of the invention.

DESCRIPTION OF PREFERRED EMBODIMENTS

These features are for illustrative purposes only and not for purposes of limiting the same. These and the other features will become apparent to those skilled in the art from the following detailed description which, taken in conjunction with the attached drawings, discloses exemplary embodiments of the invention. Various changes, modifications, and equivalents of the systems, apparatuses and/or methods described herein will suggest themselves to those of ordinary skill in the art. Descriptions of well-known functions and structures are omitted to enhance clarity and conciseness. Hereinafter, the preferred embodiments of the present invention will be described in detail with reference to the accompanying drawings.

Figure 1:
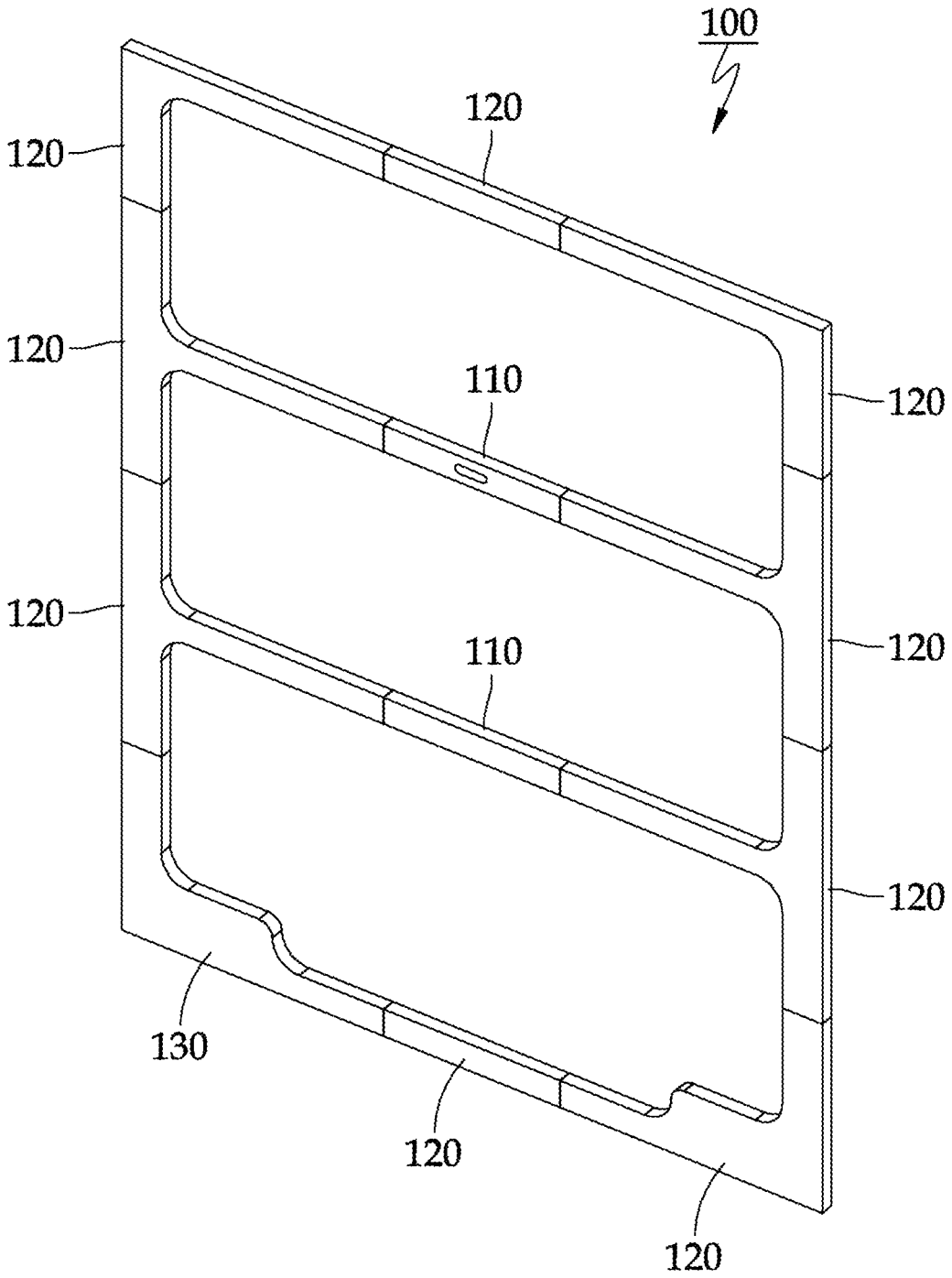
FIG. 1 is a diagram illustrating a security device according to an embodiment of the present invention.

FIG. 1 is a diagram illustrating a security device 100.

Referring to FIG. 1, the security device 100 includes one or more sensor frames 110, one or more connection frames 120, and a signal processing frame 130.

The sensor frame 110, the connection frame 120 and/or the signal processing frame 130 may be detachably connected to one another by means of a connector 111, thereby making the security device 100 in a predetermined size.

Specifically, the sensor frame 110 includes a detachable sensor 112 and outputs a signal sensed or measured by the sensor 112.

The sensor 112 may be an external sensor 112 which is installed to face the outside of a target object, such as a window, where the security device 100 is installed, in order to detect any one approaching the target object. Examples of the sensor 112 may include a passive-infrared sensor 112 to detect a change of heat from the outside of the security device 100, an ultrasonic sensor 112 using ultrasonic waves to detect any one approaching the target object from the outside, and an infrared sensor 112 using infrared rays to detect an intruder.

In addition, examples of the sensor 112 may include a motion sensor 112 to detect the motion of the security device 100. By way of example, the sensor 112 may be a tilt sensor 112 to detect a change in tilt of the security device 100 or an acceleration sensor 112 to detect an acceleration caused by the motion of the security device 100.

The sensors 112 of this kind is detachably installed in the sensor frame 110 so as to detect a target object or an intrusion from the outside of the target object.

Preferably, in order to be adapted to a variety of environments so as to detect an intrusion, the external sensor 112 and the motion sensor 112 are incorporated in the sensor frame 110 and determine by combinations of signals sensed by the two kinds of sensors 112 whether an intrusion occurs.

The security device 100 may include one or more sensor frames 110 of this kind each of which preferably includes at least one or more external sensors 112 and at least one or more motion sensors 112.

The internal structure of the sensor frame 110 will be described in more detail with reference to FIG. 3.

The connection frame 120 connects a signal sensed by the sensor frame 110 to another connection frame 120 or the signal processing frame 130. The connection frame 120 also forms the frame of the security device 100.

The connection frame 120 may also include a connector 111 on an end thereof to be detachably connected to another connection frame 120, sensor frame 110 or signal processing frame 130. A certain connection frame 120 may have a different connector 111 from that of the sensor frame 110 or may not include the connector 111.

The signal processing frame 130 converts a sensed signal outputted from the sensor 112 of the sensor frame 110 through a connected signal line from the sensor frame 110 or from the connection frame 120 into a signal value, and detects based on the signal value whether an intrusion occurs.

The signal processing frame 130 preferably includes a processor 134 to determine whether an intrusion occurs. The operations of the signal processing frame 130 will be described in more detail with reference to FIGS. 8 and 9.

Figure 2:
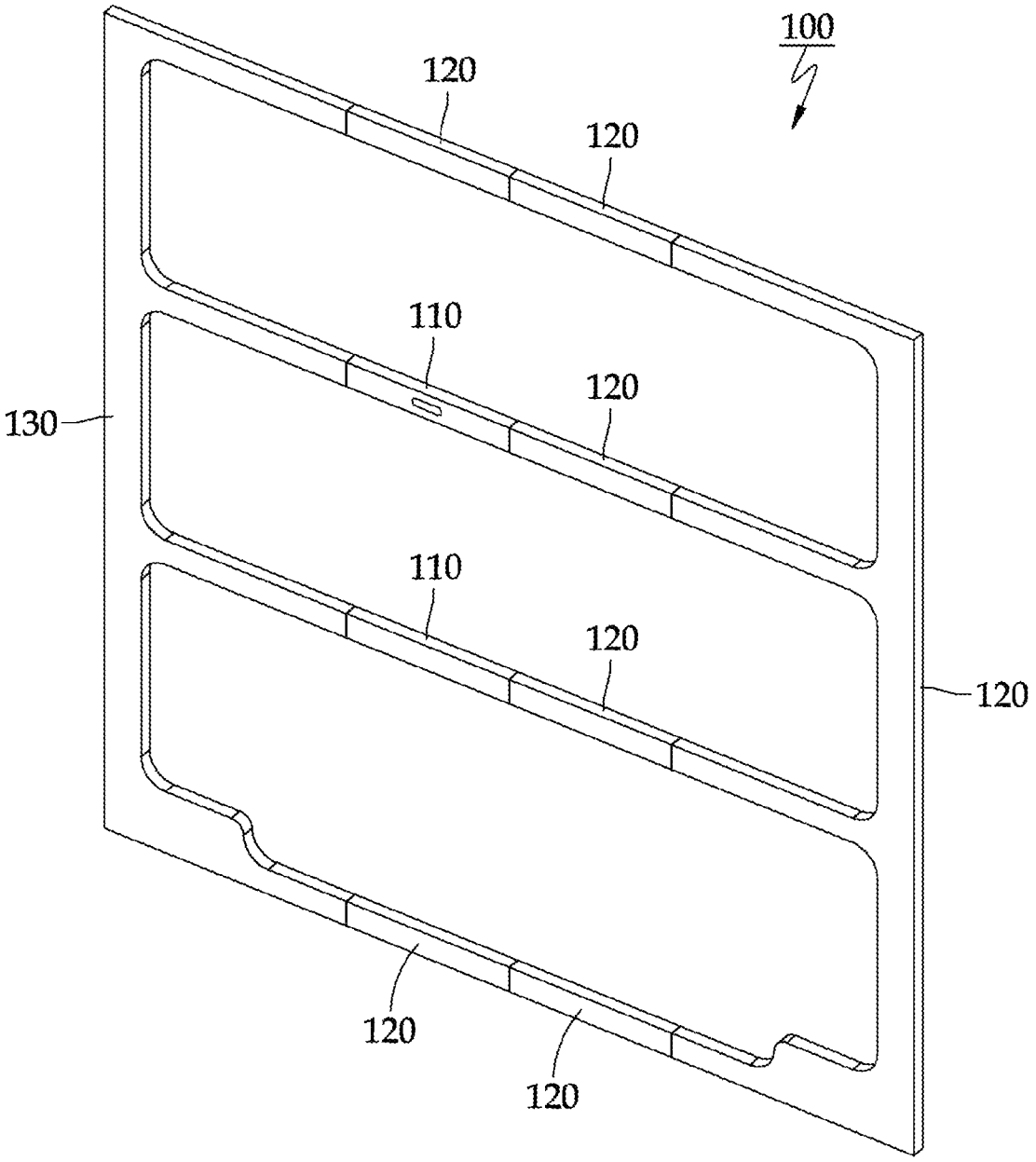
FIG. 2 is a diagram illustrating a security device according to an embodiment of the present invention.

FIG. 2 is a diagram illustrating another example of the security device 100.

Unlike FIG. 1, FIG. 2 illustrates the security device 100 which is extended in a horizontal direction.

Referring to FIG. 2, a single connection frame 120 in a vertical direction is detachably connected to another connection frame 120 in a horizontal direction. A signal processing frame 130 is solely formed in the vertical direction and detachably connected to the other connection frame 120 or a sensor frame 110. The sensor frame 110 is connected to the other connection frame 120 of the same size with or a similar size to that of the sensor frame 110 and coupled to the single connection frame 120 through the other connection frame 120 and to the signal processing frame 130.

The security device 100 may be changed in size by detachably connecting the other connection frame 120 of the same size with or similar size to that of the sensor frame 110 to the sensor frame 110 and the single connection frame 120. It should be understood that the other connection frame 120 may also be installed in the vertical direction, thereby changing the size of the security device 100 in the vertical direction.

Accordingly, the sensor frame 110 and the connection frame 120 are configured to connect signal lines within the frames to one another, thereby connecting sensed signals of the sensor frame 110 to the other connection frame 120 or signal processing frame 130.

Although FIG. 2 illustrates the security device 100 including the two sensor frames 110, the security device 100 may be modified in a different manner. By way of example, the security device 100 may be modified in such a manner that one or more connection frames 120 are substituted with one or more sensor frames 110 and sensed signals from a variety of the sensor frames 110 are detected, thereby detecting the malfunction of sensors 112. For example, in a case where a plurality of sensors 112 of the same kind are installed, the malfunction of one of the sensors 112 may be detected and thus the user may not experience inconvenience caused by the malfunction of the sensor 112.

Figure 3:
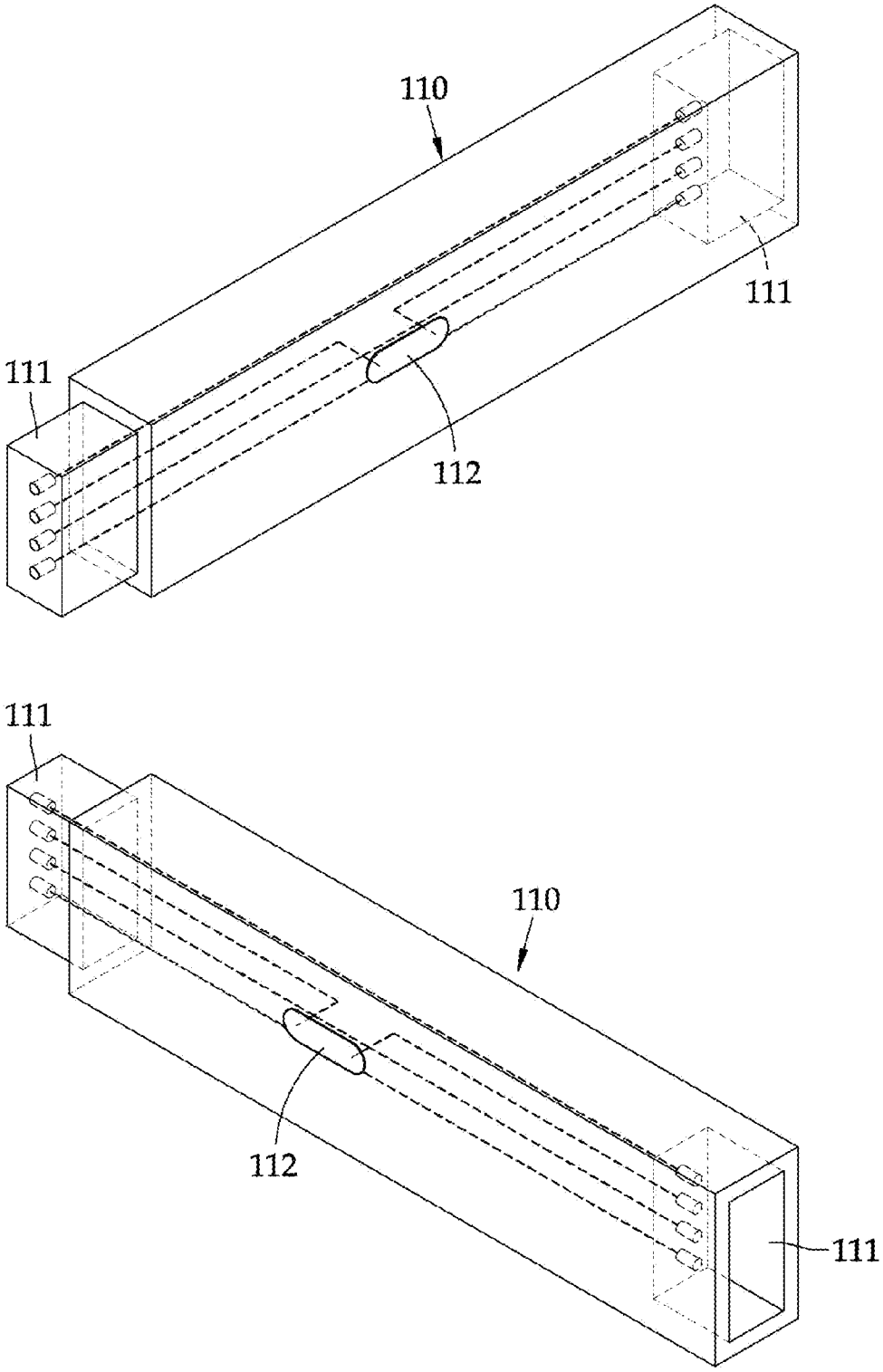
FIG. 3 is a diagram illustrating a structure of a sensor frame according to an embodiment of the present invention.

FIG. 3 is a diagram illustrating the structure of the sensor frame 110. The sensor frame 110 includes one or more signal lines, preferably a plurality of signal lines, where a certain signal line and another signal line corresponding to the certain signal line are connected to the sensor 112. The sensor 112 is detachably connected to the sensor frame 110. Accordingly, sensors 112 with a variety of uses may be detachably connected to the sensor frame 110.

One or more of the plurality of signal lines in the sensor frame 110 are designated to be individually allocated to certain sensors 112 or allocated depending on the position of the sensor frame 110 in the security device 100. Meanwhile, the other one or two of the plurality of signal lines are allocated to detect disconnection in the security device 100, i.e., an open circuit of the security device 100.

The signal lines for detecting an open circuit of the security device 100 are connected to one another in all of the frames in the security device 100 so that the signal processing frame 130 can recognize or detect the disconnection of one of the frames. The signal lines for detecting an open circuit are also connected to all of the sensor frames 110.

The sensor frame 110 further includes the connector 111. The sensor frame 110 is detachably connected to another sensor frame 110, another connection frame 120 and/or another signal processing frame 130 by means of the connector 111 so that a plurality of signal lines in each frame can be connected to one another.

The connector 111 shown in FIG. 3 may also be included in the other frames. By way of example, the signal processing frame 130 and the connection frame 120 may also include the connector 111 for the security device 100. The connectors 111 at both ends of the sensor frame 110 or the other frame may have different shapes to each other, for example, female and male connectors 111.

Each signal line may be allocated to each sensor 112 in advance or randomly by the processor 134 of the signal processing frame 130 depending on the number of available sensors 112. Accordingly, the number of signal lines may vary depending on the number of sensors 112 installed in the security device 100 (refer to FIGS. 4-6).

Figure 4:
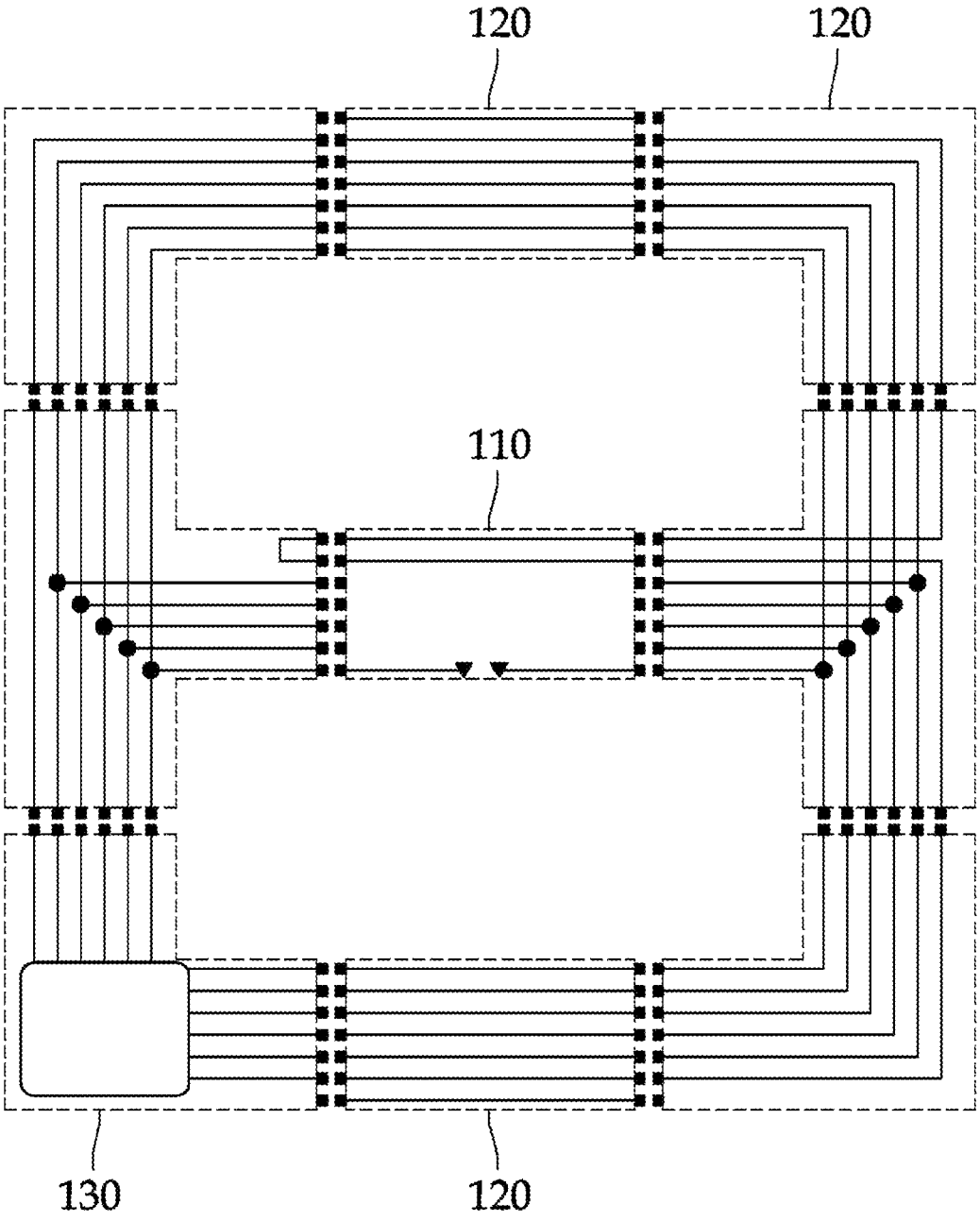
FIG. 4 is a diagram illustrating an internal connection of a security device according to an embodiment of the present invention.

FIG. 4 is a diagram illustrating an internal connection of the security device 100.

Specifically, FIG. 4 illustrates an internal connection of the security device 100 which includes a sensor frame 110, connection frames 120, and a signal processing frame 130.

As shown in FIG. 4, the signal processing frame 130 is connected to all of signal lines so as to output signals to the signal lines and receive signals from the signal lines.

The output signal may be, for example, a voltage source signal of 5V or a predetermined level of signal generated by the processor 134 included in the signal processing frame 130.

The received signal may be a signal received from the sensor frame 110 or a signal connected to all of the frames to detect disconnection.

Each sensor 112 of each sensor frame 110 is connected to a corresponding signal line to output a signal based on the type of sensor 112 to the signal processing frame 130. The sensor 112 may be, for example, an external sensor 112 or a motion sensor 112.

The external sensor 112 faces the outside of a target object, such as a window, to detect any one approaching the window, thereby detecting approaching from the outside of the window.

Figure 5:
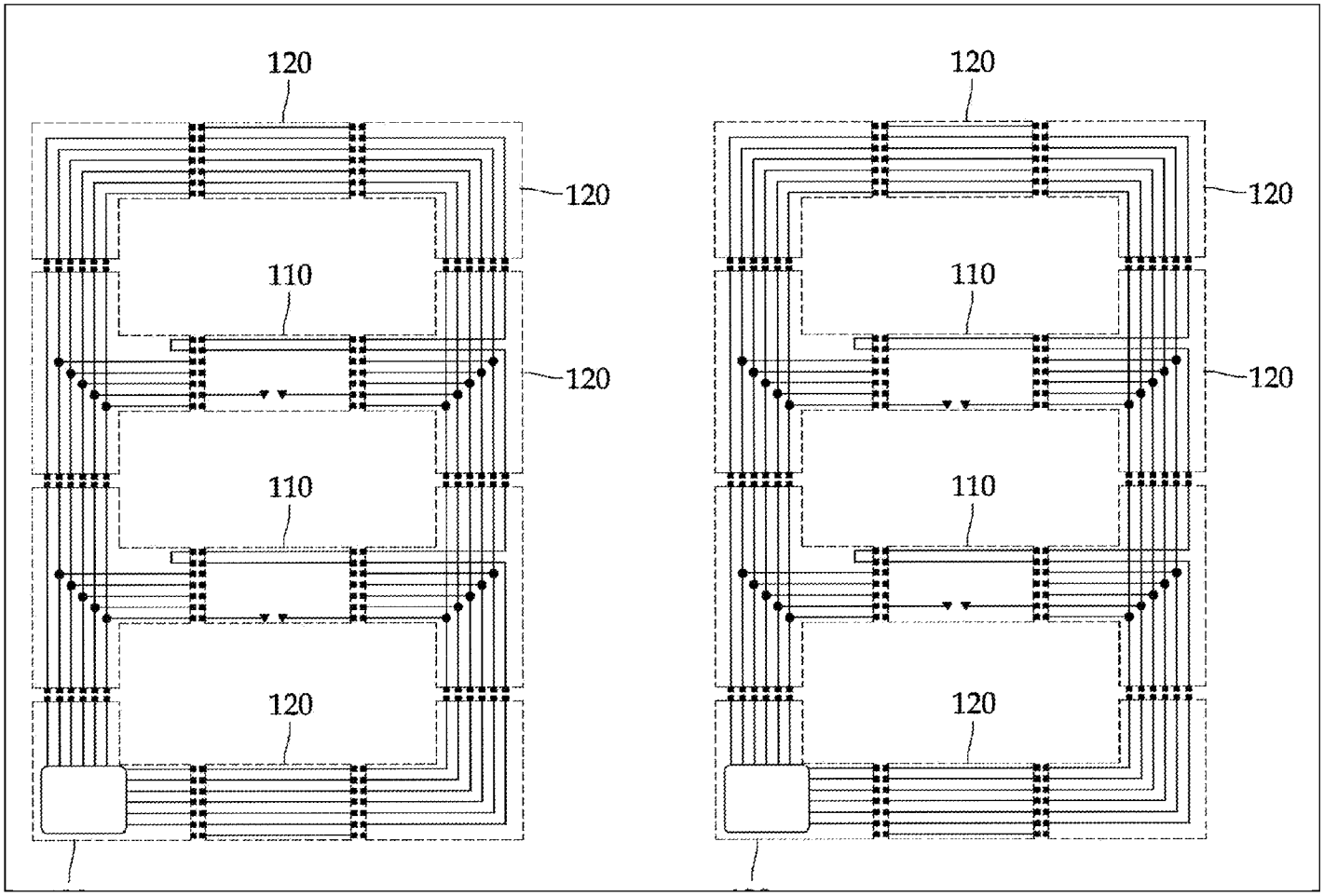
FIG. 5 is a diagram illustrating an internal connection of a security device according to an embodiment of the present invention.

FIG. 5 is a diagram illustrating another internal connection of the security device 100. Specifically, FIG. 5(*a*) illustrates an internal connection of the security device 100 including two sensor frames 110 one of which may be an external sensor 112 and the other of which may be a motion sensor 112. The sensor 112 of each sensor frame 110 is connected to a predetermined signal line. FIG. 5(*b*) is the same as FIG. 5(*a*) except that the two sensor frames 110 are switched in position.

Figure 6:
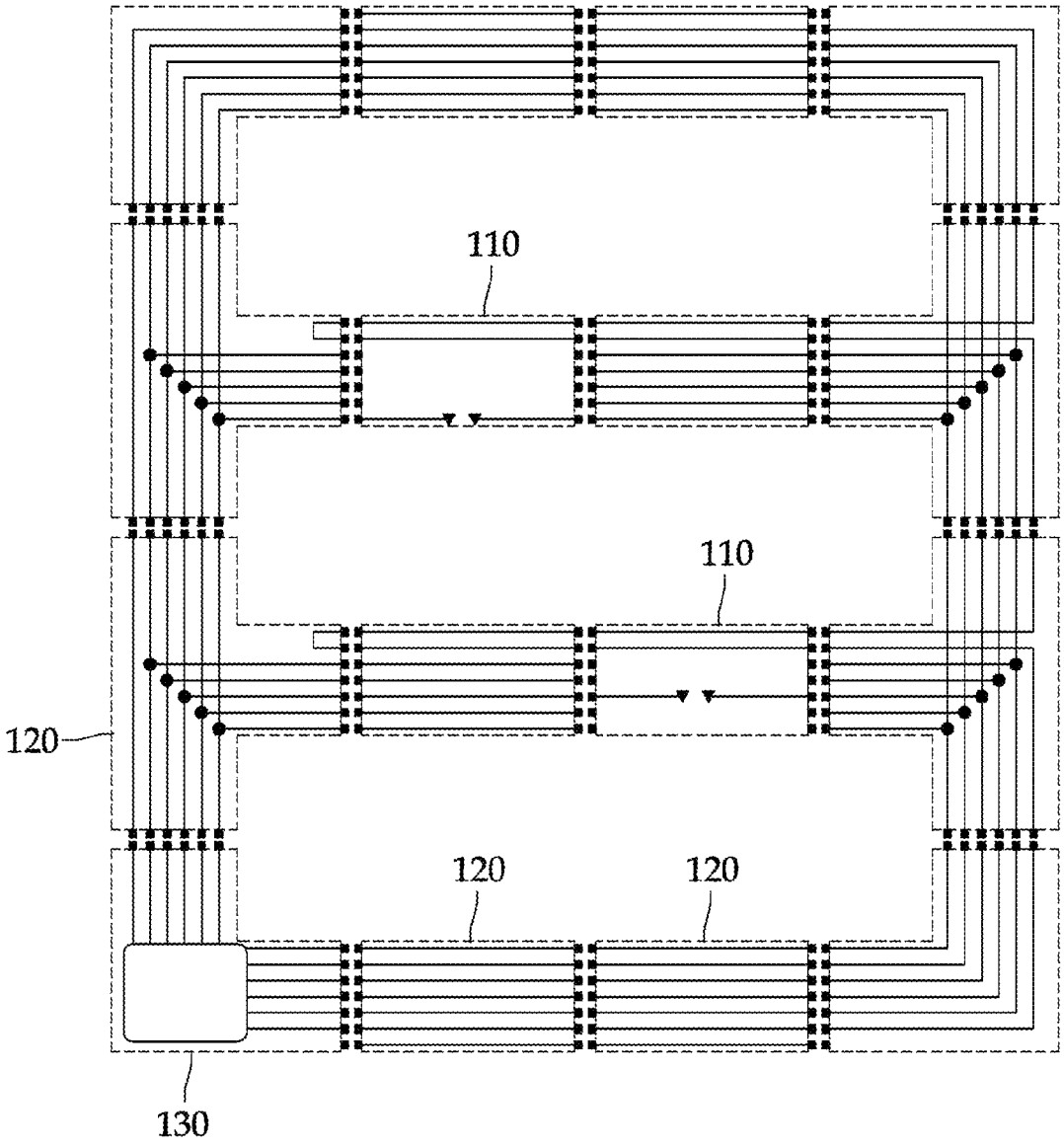
FIG. 6 is a diagram illustrating an internal connection of an extended security device according to an embodiment of the present invention.

FIG. 6 is a diagram illustrating an internal connection of an extended security device 100. Specifically, FIG. 6 illustrates an internal connection of a security device 100 which is extended in a transverse direction from the security device 100 of FIG. 5.

As shown in FIG. 6, the security device 100 may be changed in size in a transverse direction by means of a connection frame 120 which is the same with or similar to the sensor frame 110 (see (1) of FIG. 6). Likewise, the security device 100 may be easily extended in a longitudinal direction by means of an additional connection frame 120.

Accordingly, the size of the security device 100 may be easily changed according to the size of the window in which the security device 100 is installed, thereby easily detecting an intrusion regardless of the size of the window.

Figure 7:
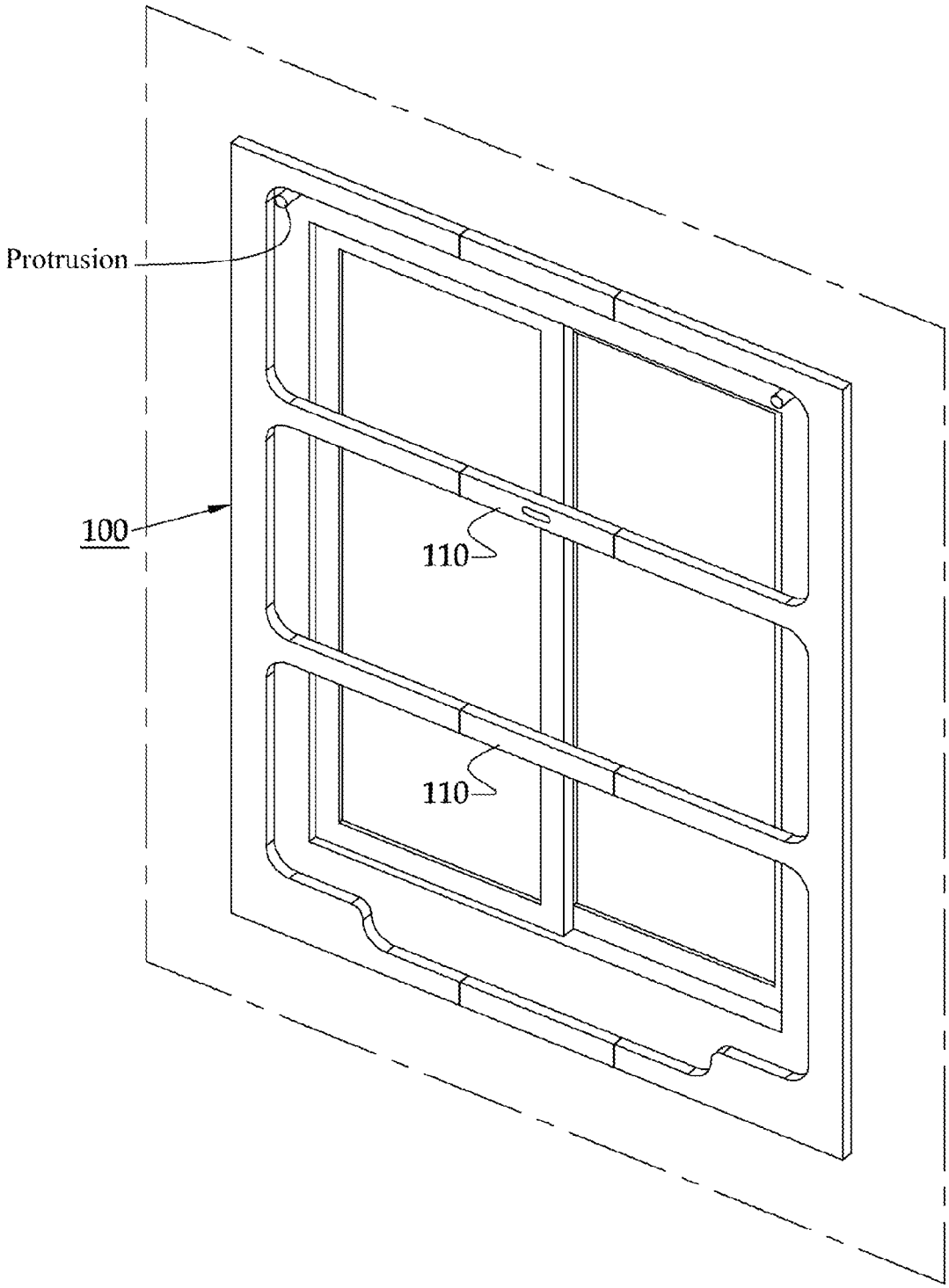
FIG. 7 is a diagram illustrating an installation of a security device according to an embodiment of the present invention.

FIG. 7 is a diagram illustrating how the security device 100 is installed according to an embodiment of the present invention.

The security device 100 may be easily installed on a target object, such as a window, using the frame structure. Referring to FIG. 7, an indoor area, such as a living room, has a plurality of windows which are installed on a wall which is a support for the windows.

On the wall or the window, a protrusion is provided to have the security device hung thereon. The protrusion may be, for example, a nail or a wooden bar which is provided on the wall or the window.

The protrusion is a structure which is made to have the security device 100 installed (hung) thereon more easily than a structure for installation of a conventional security device.

The security device 100 may be hung on the protrusion using the frame structure of the security device 100. Specifically, the security device 100 has a space according to a coupling structure between the connection frames 120, between the connection frame 120 and the sensor frame 110, or between the connection frame 120, the sensor frame 110 and the signal processing frame 130.

The security device 100 may be installed on a target object by placing (inserting) the protrusion in the space so as to support the security device 100. Accordingly, the security device 100 may be easily installed on or detached from the target object or the support.

In FIG. 7, the security device 100 may include two sensor frames 110 one of which may be a tilt sensor 112 for detecting the motion of the security device 100 and the other of which may be a passive-infrared sensor 112 for detecting any one approaching from the outside.

The tilt sensor 112 detects the motion of the security device 100, while the passive-infrared sensor 112 is installed to face the outside of the target object to detect any one approaching from the outside.

The security device 100 is installed inside business or residential buildings to detect the intrusion. Accordingly, it is possible to easily establish a security system with no worries about loss of property.

Figure 8:
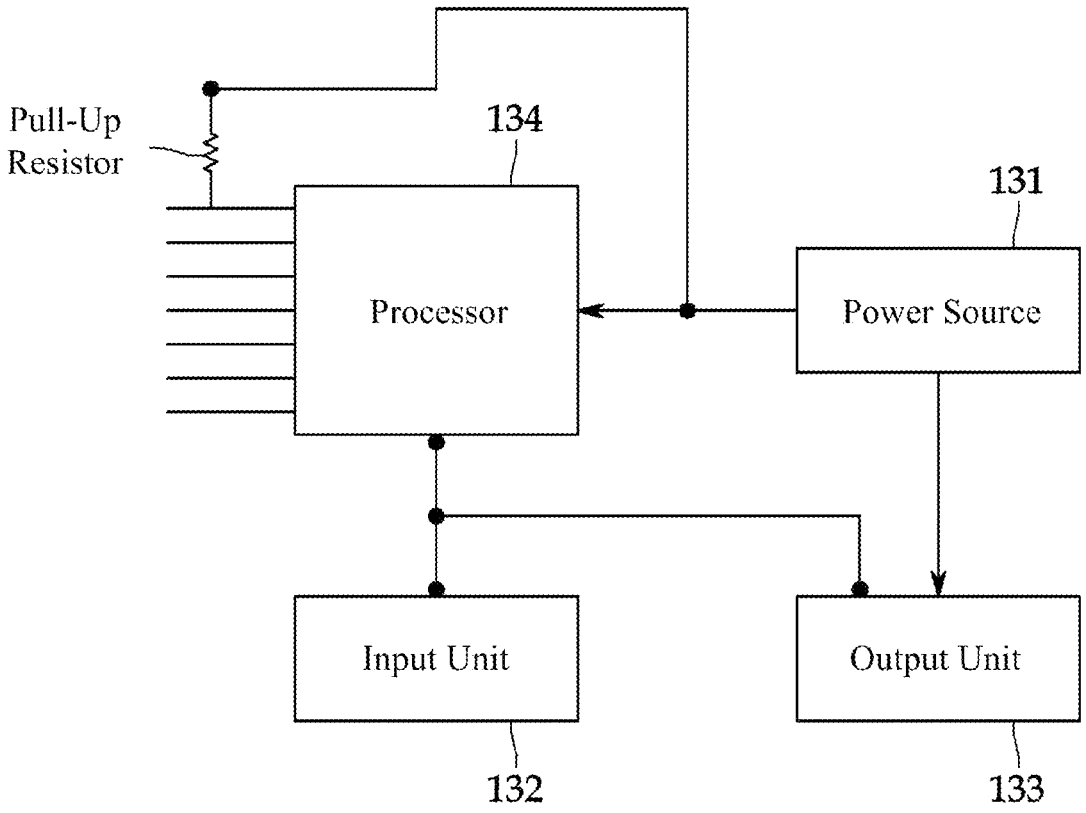
FIG. 8 is a block diagram illustrating signal processing of a signal processing frame according to an embodiment of the present invention.

FIG. 8 is a block diagram illustrating signal processing of the signal processing frame 130. The signal processing frame 130 includes an input unit 132, an output unit 133, a power source 131, and a processor 134. Some of them, for example, the input unit 132 and the output unit 133 may be omitted. Other elements may be further included in FIG. 8.

Specifically, the input unit 132 includes buttons or switches with which to receive a control input from a user. The control input may cause the security device 100 to initiate or stop monitoring of an intrusion.

The output unit 133 includes a speaker or a buzzer which is driven under the control of the processor 134. The output unit 133 outputs a warning voice or sound under the control of the processor 134, for example, when the processor 134 detects an intrusion.

The power source 131 supplies power to the elements such as the processor 134. The power source 131 includes, for example, a battery or a power converter for converting an AC source into a predetermined power source and supplies power to the processor 134 and the output unit 133.

The processor 134 controls the elements of the signal processing frame 130. The processor 134 also receives a signal sensed by the sensor 112 through a signal line and detects based on the received signal whether or not an intrusion occurs.

The processor 134 may include, for example, an execution unit for processing instructions, and may load programs from a memory included in the processor 134 or use a gate array implemented in logic to control and detect the other elements.

The processor 134 receives a signal line from each sensor frame 110, converts the signal into a digital value (or further includes an analog digital converter (ADC)), and determines based on the converted signal value whether or not an intrusion occurs.

Taking into account a situation where signal lines received from each sensor frame 110 are not connected, the processor 134 is connected to a pull-up or pull-down resistor, which is connected to a designated power source, to detect a basic power source when there is no signal line.

Among the signal lines inputted to the processor 134 is a signal line for detecting an open circuit.

The signal lines inputted to the processor 134 are connected in parallel to the pull-down or pull-up resistor or to a resistor opposing to a logic signal. Accordingly, when the sensor 112 of interest is open or disconnected, the processor 134 easily recognizes the opened or disconnected sensor 112 by means of the pull-down or pull-up resistor.

The intrusion detection control of the processor 134 will be described in detail with reference to FIG. 9.

Figure 9:
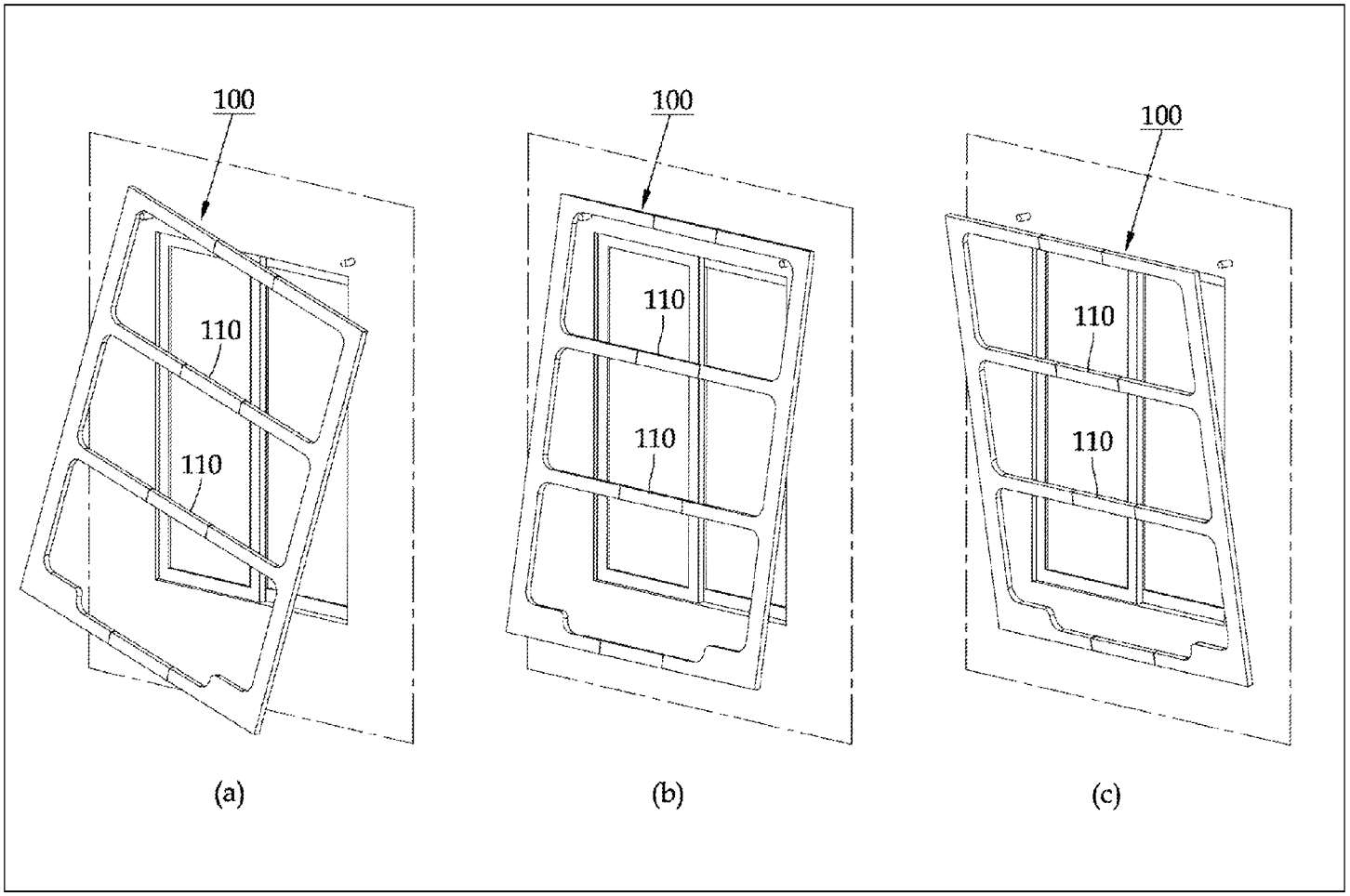
FIG. 9 is a diagram illustrating a motion pattern of a security device upon an intrusion according to an embodiment of the present invention.

FIG. 9 is a diagram illustrating a motion pattern of a security device 100 when an intrusion occurs according to an embodiment of the invention. Specifically, FIG. 9 illustrates two sensor frames 110 one of which includes a passive-infrared sensor 112 and the other of which includes a tilt sensor 112.

FIG. 9(*a*) illustrates a motion pattern of the security device 100 tilting and falling when an intruder tries to make an intrusion. FIG. 9(*b*) and FIG. 9(*c*) illustrate other motion patterns of the security device 100 tilting when an intruder tries to make an intrusion.

In FIGS. 9(*a*)-9(*c*), the passive-infrared sensor 112 facing the outside may detect a change in passive infrared, while the tilt sensor may detect a motion of the security device 100.

On the other hand, in case of an approaching individual (e.g., a passerby) other than an intruder, the tilt sensor 112 may detect no motion of the security device 100 since the security device 100 does not move.

Likewise, since the passive-infrared sensor 112 detects a change in passive infrared from the outside, the passive-infrared sensor 112 cannot detect a change in passive infrared if the security device 100 is moved by the user inside the room manipulating the security device 100 (e.g., by the user touching the security device 100).

The processor 134 in the signal processing frame 130 may detect an intrusion by combinations of the sensed signals of the sensors 112 (the passive-infrared sensor 112 and the tilt sensor 112 in this embodiment) and output a warning through the output unit 133.

More specifically, the processor 134 detects whether or not a signal value of a sensed signal received from the passive-infrared sensor 112 is changed to more than a predetermined threshold. The detection may be performed at regular intervals (e.g., once a second). The threshold may be determined in advance by a program set upon installation of the security device 100 or from signal values of sensed signals received at regular intervals (e.g., a value obtained by adding a predetermined signal value to an average of signals, where the average may vary depending on the season or the day or night time).

In addition, the processor 134 uses a signal line different from a signal line of the passive-infrared sensor 112 to detect whether or not a signal value of a sensed signal from the tilt sensor 112 is changed to more than a predetermined threshold. The detection may be performed at regular intervals.

If the signal value from the passive-infrared sensor 112 exceeds the threshold and the signal value from the tilt sensor 112 also exceeds the threshold, the processor 134 determines that an intrusion is detected, and outputs a warning through the output unit 133.

On the other hand, if the signal value from any one of the passive-infrared sensor 112 and the tilt sensor 112 exceeds the threshold and the signal value from the other one is below the threshold, the processor 134 determines that no intrusion is detected. In this case, the processor 134 may not output a warning through the output unit 133.

Although the above-mentioned embodiment has been described using the passive-infrared sensor 112 and the tilt sensor 112, the other sensors 112 may be used so that the security device 100 may be adapted to a variety of intrusion situations with combinations of sensed values of the other sensors 112.

The processor 134 may determine from a signal line for detecting an open circuit whether or not disconnection has occurred. In case of the open circuit, the processor 134 may output a warning through the output unit 133.

Accordingly, under the control of the processor 134, it can be accurately determined by combinations of sensed values of a variety of sensors 112 whether or not an intrusion occurs.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

The invention claimed is:

1. A security device for detecting an intrusion, the device comprising:

at least one sensor frame including a sensor;

a first connection frame for connecting a signal sensed from the sensor frame; and a signal processing frame for detecting an intrusion from the sensed signal received from the first connection frame or the sensor frame, wherein the at least one sensor frame is detachably connected to the security device, wherein the at least one sensor frame, the first connection frame, and the signal processing frame are assembled to form a security device frame having at least one empty space enclosed by the security device frame, wherein the frame enclosing the at least one empty space is configured to be hung on one or more protrusions of an window or a wall for supporting the window, and a substantial portion of the empty space corresponding to the size of the window, wherein the sensor is configured to detect motion of the security device hung on the one or more protrusions.

2. The security device of claim 1, wherein the at least one sensor frame comprises a connector for transmitting the sensed signal and is detachably connected to the first connection frame or the signal processing frame.

3. The security device of claim 1, further comprising a second connection frame for connecting the signal sensed from the sensor frame to the signal processing frame, wherein the second connection frame is connected to the sensor frame by means of a connector so that the security device is changed in size.

4. The security device of claim 1, wherein the signal processing frame receives signal lines more than a number of the at least one sensor frame, and wherein the signal processing frame comprises a processor to process the sensed signal received from each sensor frame using each signal line.

5. The security device of claim 4, wherein the at least one sensor frame comprises a plurality of sensor frames, wherein a first one of the plurality of sensor frames comprises a passive-infrared sensor and a second one of the plurality of sensor frames comprises a tilt sensor, and wherein the processor of the signal processing frame detects an intrusion from signals sensed from the passive-infrared sensor and the tilt sensor.

6. The security device of claim 5, wherein the security device detects an open circuit using a signal line different from the signal lines for transmitting the sensed signals from the sensor frames.

7. The security device of claim 6, wherein the signal line used in detecting the open circuit is connected to the first sensor frame and the second sensor frame.

8. The security device of claim 5, wherein the processor detects the intrusion by combinations of the signals sensed from the passive-infrared sensor and the tilt sensor.

9. The security device of claim 8, wherein the signal processing frame further comprises an output unit for outputting a warning in case of the intrusion, wherein the processor is configured to determine the intrusion only when the passive-infrared sensor detects external heat in amount greater than a predetermined first threshold value, and the tilt sensor detect a tilt in amount greater than a predetermined second threshold value, and output, when the intrusion is determined, a warning through the output unit.

10. A security device for detecting an intrusion, the device comprising:

a first sensor which is installed to face outside to detect approaching a target object; and a second sensor which detects motion of the security device, wherein the security device is formed to be hung on the target object or a support member of the target object, wherein the security device has a frame shape which has at least one empty space enclosed by the frame shape of the security device, wherein the frame enclosing the at least one empty space is configured to be hung on one or more protrusions of the target object or the support member, and a substantial portion of the empty space corresponding to the size of the target object, wherein the second sensor is configured to detect the motion of the security device hung on the one or more protrusions.

11. The security device of claim 10, further comprising at least one frame, wherein the security device is hung on the target object or the support member of the target object by means of a frame structure of the at least one frame.

12. The security device of claim 10, wherein the first sensor comprises a passive-infrared sensor to detect external heat or an ultrasonic sensor to detect approaching from the outside using ultrasonic waves, wherein the second sensor comprises a tilt sensor to detect tilt of the security device or an acceleration sensor to detect acceleration based on the motion of the security device, and wherein the security device determines an intrusion by combinations of signal values from the first sensor and the second sensor.

13. The security device of claim 12, wherein the security device determines the intrusion only when the passive-infrared sensor detects the external heat or the ultrasonic sensor detects echoes of the ultrasonic waves in amount greater than a predetermined first threshold value, and the tilt sensor detects the tilt of the security device or the acceleration sensor detects the acceleration in amount greater than a predetermined second threshold value.

14. The security device of claim 12, wherein when a signal value from one of the first and second sensors is changed to more than a predetermined threshold value and a signal value from the other one is changed below a predetermined threshold value, the security device determines that an intrusion is not detected.

15. The security device of claim 10, wherein the target object is a window and the support member of the target object is a wall for supporting the window.

* * * * *